US009427962B2

(12) United States Patent
Fukuda

(10) Patent No.: US 9,427,962 B2
(45) Date of Patent: Aug. 30, 2016

(54) LIQUID EJECTING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/445,725

(22) Filed: Jul. 29, 2014

(65) Prior Publication Data

US 2015/0035885 A1 Feb. 5, 2015

(30) Foreign Application Priority Data

Aug. 5, 2013 (JP) ..... 2013-162012
Feb. 21, 2014 (JP) ..... 2014-031304

(51) Int. Cl.
*B41J 2/045* (2006.01)

(52) U.S. Cl.
CPC ..... *B41J 2/04588* (2013.01); *B41J 2/0459* (2013.01); *B41J 2/04573* (2013.01); *B41J 2/04581* (2013.01)

(58) Field of Classification Search
CPC ..... B41J 2/04581; B41J 2/04588; B41J 2/04541; B41J 2/04593; B41J 2/0458; B41J 2/04573; B41J 2/0459
USPC ..... 347/10
See application file for complete search history.

(56) References Cited

U.S. PATENT DOCUMENTS 8,905,507 B2 * 12/2014 Mitsuki ..... B41J 29/38 347/10
2003/0085962 A1 5/2003 Junhua
2004/0257391 A1 * 12/2004 Hosono ..... B41J 2/04581 347/11
2005/0127780 A1 * 6/2005 Ifuku ..... B41J 2/161 310/311
2006/0238554 A1 10/2006 Hosono et al.
2013/0083104 A1 * 4/2013 Mitsuki ..... B41J 29/38 347/10
2015/0042710 A1 * 2/2015 Fukuda ..... B41J 2/04588 347/10

FOREIGN PATENT DOCUMENTS

EP 1088662 4/2001
JP 2001-138551 5/2001

OTHER PUBLICATIONS

European Search Report for Application No. 14179873.6 dated Jan. 27, 2015.

* cited by examiner

*Primary Examiner* — Manish S Shah
*Assistant Examiner* — Yaovi M Ameh
(74) *Attorney, Agent, or Firm* — Workman Nydegger

(57) ABSTRACT

A drive signal includes a first drive pulse that causes liquid droplets to be ejected from nozzles and a second drive pulse that causes liquid droplets of a different size to those of the first drive pulse to be ejected from the nozzles. Each pulse includes at least an expansion element that causes a pressure chamber to expand by changing from a standard potential, which is a standard for changes in potential, to an expansion potential, a contraction element that causes the expanded pressure chamber to contract by changing from a potential that is on an expansion potential side of the standard potential to a contraction potential that exceeds the standard potential thereby ejecting the liquid. Initiation potentials of the contraction elements of the first and second drive pulses are made to be uniform at the same potential.

5 Claims, 6 Drawing Sheets

LIQUID EJECTING APPARATUS

The present application claims priority to Japanese Patent Application No. 2013-162012 filed on Aug. 5, 2013 and Japanese Patent Application No. 2014-031304 filed on Feb. 21, 2014, which is hereby incorporated by reference in its entirety.

BACKGROUND

1. Technical Field

Embodiments of the present invention relate to a liquid ejecting head that causes liquid droplets to be ejected from nozzles by supplying a drive signal to a piezoelectric body, a driving method for driving ejection of liquid droplets from the liquid ejecting head. Embodiments of the present invention also related to a liquid ejecting apparatus that is provided with the liquid ejecting head, and a driving method for driving ejection of liquid droplets from the liquid ejecting apparatus.

2. Related Art

A liquid ejecting apparatus is an apparatus provided with a liquid ejecting head that is capable of ejecting various kinds of liquid as liquid droplets from nozzles. Examples of the liquid ejecting apparatus include, for example, image recording apparatuses (hereinafter, referred to as printers), such as ink jet recording apparatuses, that are provided with an ink jet recording head (hereinafter, referred to as a recording head), and perform recording by ejecting ink in liquid form as ink droplets from nozzles of the recording head. Further, in addition to the above, certain liquid ejecting apparatuses can be used to eject various types of liquids, such as coloring materials that are used in color filters for liquid crystal displays and the like, organic materials that are used in organic EL (Electro Luminescence) displays, and electrode materials that are used in electrode formation. Further, in some image recording apparatuses liquid ink is ejected from recording heads, and solutions of the respective color materials of R (Red), G (Green) and B (Blue) can be ejected from color material ejecting heads for display production apparatuses. In addition, a liquid electrode material can be ejected from electrode material ejecting heads for electrode formation apparatuses, and solutions of living organic matter can be ejected in living organic matter ejecting heads for chip production apparatuses.

A recording head, such as those mentioned above, can be provided with a piezoelectric element that causes pressure fluctuations in ink inside a pressure chamber. The piezoelectric element has a common electrode that is common to a plurality of piezoelectric elements and an individual electrode that is patterned individually in each piezoelectric element. A piezoelectric body layer (piezoelectric body film) is interposed between these electrodes, while a flexible cable electrically connects to terminals of the common electrode and the individual electrode.

When a drive signal (drive voltage) is supplied between the common electrode and the individual electrode through the flexible cable, an electrical field between the two electrodes is formed; the strength of the electrical field depending on a difference in voltage potential between the two electrodes. For example, normally, a constant potential is applied to the common electrode, and an oscillatory waveform is applied to the individual electrode. With this configuration, the piezoelectric element (piezoelectric body film) for example, bends and deforms depending on the intensity of the electrical field, which in turn causes a pressure fluctuation in ink inside the pressure chamber. This pressure fluctuation also results in the recording head ejecting ink droplets from the nozzles In addition, the abovementioned drive signal may include a series of drive pulses with different waveforms. The drive pulses selectively applied to the piezoelectric element cause the recording head to eject ink droplets from the nozzles; a size (amount) of the ink droplets corresponding to the selectively applied drive pulses. For example, the drive signals that are shown in FIGS. 7A and 7B are provided with a large dot drive pulse PL that forms large dots on a recording medium (landing target), such as recording paper, by ejecting comparatively large ink droplets. The illustrated drive signal in FIGS. 7A and 7B also include a small dot drive pulse PS that forms small dots on the recording medium by ejecting comparatively small ink droplets. Both drive pulses PL and PS are provided with expansion elements p81 and p91 that cause a pressure chamber to expand by changing from an intermediate potential VC (a potential that is halfway between a maximum potential and a minimum potential) to expansion potentials VLL and VLS. Both drive pulses PL and PS are also provided with expansion retention elements p82 and p92 that retain the expanded pressure chamber for a set period of time by retaining the expansion potentials VLL and VLS and contraction elements p83 and p93 that cause the expanded pressure chamber to contract by changing from the expansion potentials VLL and VLS to contraction potentials VHL and VHS.

In addition, each drive pulse can be optimized for each recording head so that target ink droplets are ejected. More specifically, a difference in potential between the expansion potentials VLL and VLS and the contraction potentials VHL and VHS can be adjusted for each recording head. For example, in the drive signal that is shown as an example in FIG. 7A, a difference in potential (a maximum difference in potential) between the expansion potential VLS and the contraction potential VHS of the small dot drive pulse PS is set to be greater than a difference in potential (a maximum difference in potential) between the expansion potential VLL and the contraction potential VHL of the large dot drive pulse PL. On the other hand, in the drive signal that is shown as an example in FIG. 7B, a difference in potential (a maximum difference in potential) between an expansion potential VLL' and a contraction potential VHL' of a large dot drive pulse PL' is set to be greater than a difference in potential (a maximum difference in potential) between an expansion potential VLS' and a contraction potential VHS' of a small dot drive pulse PS'. Additionally, the end terminal potentials of the large dot drive pulses PL and PL' and the start terminal potentials of the small dot drive pulses PS and PS' are connected and set to be uniform at the intermediate potential VC. In a printer that has this kind of drive signal, multi-gradation recording can be performed by selecting a drive pulse from the drive pulses in the drive signal, and changing the size (or number) of dots that are formed in a predetermined region (a pixel region) of a recording medium (a landing target), such as recording paper.

Given the above, an amount of displacement (an amount of deformation) of the piezoelectric body layer (the piezoelectric body) based upon an applied drive voltage (a difference in potential between the common electrode and the individual electrode) has a non-linear property (more specifically, a hysteretic property). In the piezoelectric properties of this kind of piezoelectric body layer, a linear region in which the piezoelectric properties have a linearity that is substantially close to a straight line is present in a certain region of the drive voltage. For example, in the piezoelectric properties of a piezoelectric body layer that is shown as an example in FIG. 6, a linear region L (a portion that is enclosed by a dashed line in FIG. 6) is present in the vicinity of where the drive voltage is 0. In this linear region L, a ratio of the amount of displacement with respect to the drive voltage is larger than non-linear regions other than the linear region L. Therefore, it may be desirable to adjust the drive signal so that the piezoelectric body is driven in the linear region L as often as possible.

On the other hand, there are circumstances in which the piezoelectric properties deviate from expected piezoelectric properties due to variation in the time of production and the like. When the piezoelectric properties of the piezoelectric body layer deviate, there is a concern that the ejecting properties of ink droplets ejected from the nozzles will deviate from the properties originally expected. Therefore, an apparatus that is configured to set the intermediate potential of the drive signal applied to the piezoelectric element to an optimum potential so as to suppress the influence of variations in the properties (the piezoelectric properties of the piezoelectric body layer) of the piezoelectric element of each recording head has been suggested (for example, refer to JP-A-2001-138551). That is, it is more convenient to adjust the intermediate potential than to adjust the potentials or inclinations of the constituent elements of the drive pulses, such as the drive pulses described in FIGS. 7A and 7B.

However, in a drive signal that has two or more pulses with differences in potential between the expansion potential and the contraction, there is a concern that adjusting the intermediate potential in the abovementioned manner will result in one drive pulse deviating from optimum conditions if another of the drive pulses is adjusted so as to match optimum conditions at which optimum ejection is performed. For example, in a case in which the piezoelectric body layer has piezoelectric properties such as those shown in FIG. 6, in the drive signal that is shown in FIG. 7A the expansion potential VLS of the small dot drive pulse PS matches a drive voltage V1, the contraction potential VHS matches a drive voltage V4, the expansion potential VLL of the large dot drive pulse PL matches a drive voltage V2 that is higher than the drive voltage V1, and the contraction potential VHL matches a drive voltage V3 that is lower than the drive voltage V4. With this in mind, in a case in which the potential of the large dot drive pulse PL is completely shifted to a low potential side to match the potential with a potential ideal for driving using the large dot drive pulse PL, that is, drive pulse balancing the amount of expansion and the amount of contraction of the pressure chamber, the intermediate potential VC is shifted to a low potential side. As a result, the small dot drive pulse PS is also completely shifted to a low potential side. This results in the expansion potential VLS of the small dot drive pulse PS being shifted to a region in which the inclination of the piezoelectric properties is smaller than the V1 (a region in which a ratio of the amount of displacement with respect to the drive voltage is small), and the contraction potential VHS being shifted to a region in which the inclination of the piezoelectric properties is larger than the V4 (a region in which a ratio of the amount of displacement with respect to the drive voltage is large). Therefore, driving due to the small dot drive pulse PS deviates from the ideal driving that is aimed for. That is, if the ejecting properties of ink droplets ejected from the nozzles using the large dot drive pulse PL are made to match intended properties, there is a concern that the ejecting properties of ink droplets ejected from the nozzles using the small dot drive pulse PS will deviate from the properties that are originally intended.

In addition, in the drive signal that is shown in FIG. 7B, the expansion potential VLL' of the large dot drive pulse PL' matches a drive voltage V1 and the contraction potential VHL' matches a drive voltage V4. Further, in the drive signal that is shown in FIG. 7B, the expansion potential VLS' of the small dot drive pulse PS' matches a drive voltage V2 that is higher than the drive voltage V1 and the contraction potential VHS' matches a drive voltage V3 that is lower than the drive voltage V4. With this in mind, in a case in which the potential of the small dot drive pulse PS' is completely shifted to a low potential side to match the potential with a potential ideal for driving using the small dot drive pulse PS', an intermediate potential VC' is shifted to a low potential side. As a result, the large dot drive pulse PL' is also completely shifted to a low potential side. This results in the expansion potential VLL' of the large dot drive pulse PL' being shifted to a region in which the inclination of the piezoelectric properties is smaller than the V1 (a region in which a ratio of the amount of displacement with respect to the drive voltage is small), and the contraction potential VHL' being shifted to a region in which the inclination of the piezoelectric properties is larger than the V4 (a region in which a ratio of the amount of displacement with respect to the drive voltage is large). Therefore, driving due to the large dot drive pulse PL' deviates from the ideal driving that is aimed for. That is, if the ejecting properties of ink droplets ejected from the nozzles using the small dot drive pulse PS' are made to match intended properties, there is a concern that the ejecting properties of ink droplets ejected from the nozzles using the large dot drive pulse PL' will deviate from the properties that are originally intended.

In this manner, in the related art, in a drive signal that has two or more different pulses, it is not possible to eject liquid droplets with optimal conditions that match the individual piezoelectric properties of the piezoelectric body layer in all of the pulses. In particular, in recent years, the thinning of piezoelectric body layers (piezoelectric bodies) has been progressing along with the miniaturization of recording heads. If the film thickness of the piezoelectric body layer is reduced, since the linear region L in the piezoelectric properties of the piezoelectric body layer becomes smaller, or in other words, since the non-linear region becomes larger, it becomes more likely that a range of the drive voltage that is used by other drive pulses will match the non-linear region. Therefore, deviation of ejecting properties such as that mentioned above becomes significant. In addition, as thinning of the piezoelectric body layer progresses, the amount of displacement of the piezoelectric body layer itself is reduced. Therefore, if the piezoelectric body layer (piezoelectric element) is driven in a region that is shifted from the linear region L in which the ratio of the amount of displacement with respect to the drive voltage is large, there is a concern that it will not be possible to apply a sufficient pressure fluctuation to the ink inside the pressure chamber.

SUMMARY

Embodiments of the invention relate to a liquid ejecting head that is capable of ejecting liquid droplets with optimum conditions that match the piezoelectric properties of a piezoelectric body, a driving method for ejecting liquid from the liquid ejecting head, and a liquid ejecting apparatus, and associated method of use, that includes the liquid ejecting head.

In an illustrative example, t liquid ejecting apparatus includes a liquid ejecting head that has a piezoelectric body that deforms due to a drive signal being applied thereto, and is capable of ejecting liquid droplets from nozzles by bringing about a pressure fluctuation in a liquid inside a pressure chamber by using the deformation of the piezoelectric body. The apparatus also includes a drive signal generator that generates the drive signal, which includes a first drive pulse that causes liquid droplets to be ejected from the nozzles and a second drive pulse that causes liquid droplets of a different size to those of the first drive pulse to be ejected from the nozzles. The first drive pulse and the second drive pulse have at least an expansion element that causes the pressure chamber to expand by changing from a standard potential, which is a standard for changes in potential, to an expansion potential. The first drive pulse and the second drive pulse also have at least a contraction element that causes the expanded pressure chamber to contract by changing from a potential that is on an expansion potential side of the standard potential to a contraction potential that exceeds the standard potential thereby ejecting the liquid. The first drive pulse and the second drive pulse also have at least an initiation potential of the contraction element of the first drive pulse and an initiation potential of the contraction element of the second drive pulse that are set to be uniform at the same potential.

In addition, in the abovementioned configuration, it is desirable that the drive signal include a third drive pulse that causes liquid droplets of a different size from those ejected from the nozzles by the first drive pulse and the second drive pulse. The third drive pulse has at least (i) an expansion element that causes the pressure chamber to expand by changing from a standard potential, which is a standard for changes in potential, to an expansion potential, and a contraction element that causes the expanded pressure chamber to contract by changing from a potential that is on an expansion potential side of the standard potential to a contraction potential that exceeds the standard potential thereby ejecting the liquid. An initiation potential of the contraction element of the third drive pulse can be made to be uniform at the same potential as the initiation potential of the contraction element of the first drive pulse and the initiation potential of the contraction element of the second drive pulse.

Furthermore, in the abovementioned illustrative configuration, the third drive pulse causes liquid droplets that are smaller than those of the first drive pulse and larger than those of the second drive pulse to be ejected from the nozzles.

In another illustrative configuration, the drive signal includes a third drive pulse that causes liquid droplets of the same size as those of either the first drive pulse or the second drive pulse to be ejected from the nozzles. The third drive pulse, therefore, can have at least an expansion element that causes the pressure chamber to expand by changing from a standard potential, which is a standard for changes in potential, to an expansion potential. This third drive pulse can also include a contraction element that causes the expanded pressure chamber to contract by changing from a potential that is on an expansion potential side of the standard potential to a contraction potential that exceeds the standard potential to thereby eject the liquid. An initiation potential of the contraction element of the third drive pulse can be set to be uniform at the same potential as the initiation potential of the contraction element of the first drive pulse and the initiation potential of the contraction element of the second drive pulse.

Furthermore, in the abovementioned configuration, it is desirable that the piezoelectric body be formed in a film-shape in which crystal is preferentially oriented.

In another example, it is possible to match both the initiation potential of the contraction element of the first drive pulse and the initiation potential of the contraction element of the second drive pulse with an intended drive voltage in the piezoelectric properties of the piezoelectric body. As a result of this, it is possible to make ejecting properties of ink droplets that are ejected from the nozzles using both drive pulses optimal properties that match the piezoelectric properties of the piezoelectric body. That is, since the initiation potentials of the contraction elements are set to be uniform in cases in which the standard potential (an intermediate potential of one drive pulse) is increased or decreased to adjust the amount of liquid droplets that are ejected using one drive pulse, it is possible to suppress a circumstance in which the driving of the piezoelectric body using each drive pulse deviates from optimum driving conditions. As a result, it is possible to suppress a circumstance in which the liquid droplets ejected using both drive pulses are ejected with conditions that deviate from optimal conditions. Furthermore, since the expansion element in both the first drive pulse and the second drive pulse can use the maximum amount of a linear region in which the ratio of the amount of displacement with respect to the drive voltage is large, it is possible to eject liquid droplets with high efficiency. Therefore, it is possible to keep a ratio of changes in potential due to the contraction elements down.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, an embodiment for implementing the present invention will be described with reference to the appended drawings. Additionally, in the embodiments that will be described below, are described with reference to various examples, but the scope of the present invention is not limited unless a feature that limits the present invention is specifically stated in the following description. In addition, in the following description, an ink jet type recording apparatus (hereinafter, referred to as a printer 1) is used as an example of a liquid ejecting apparatus of the present invention.

Figure 1:
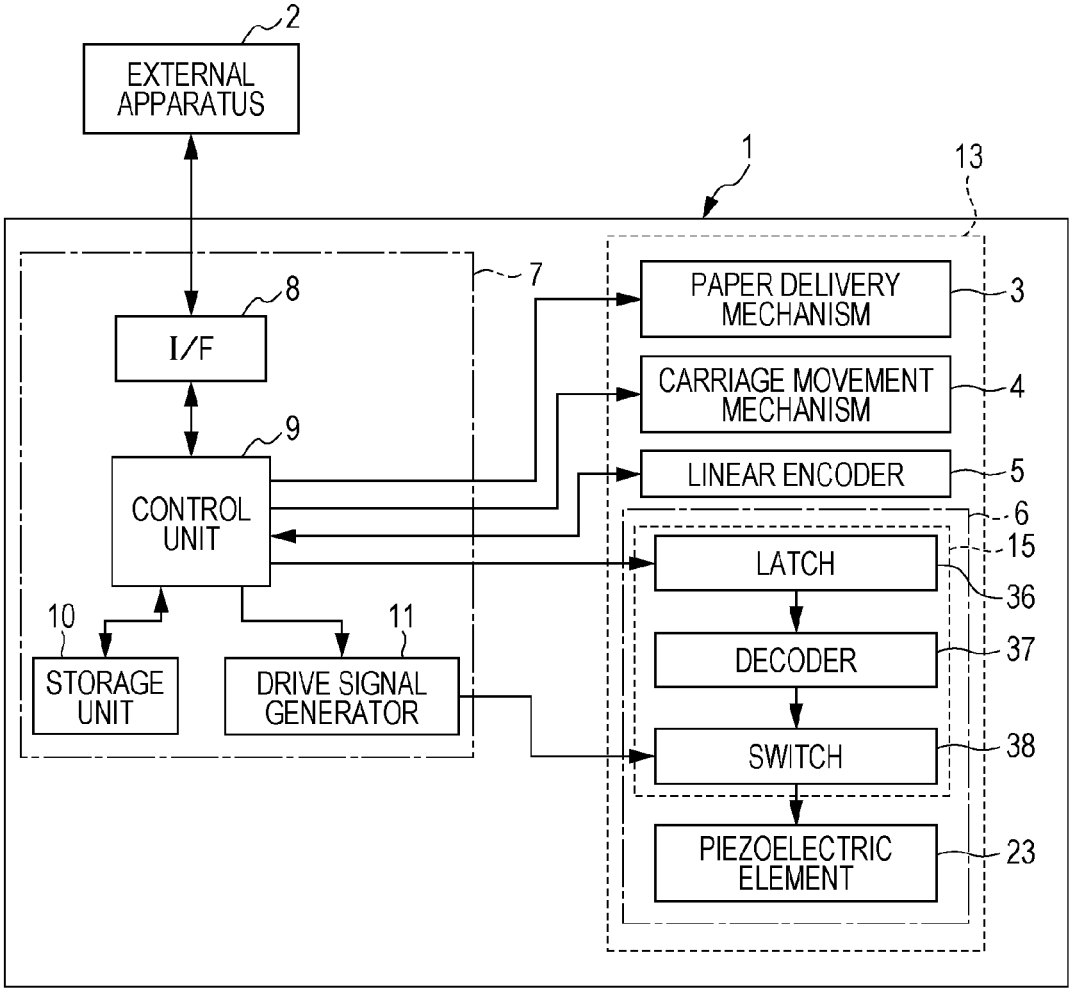
FIG. 1 is a block diagram illustrating an example of an electrical configuration of a printer.
Figure 2:
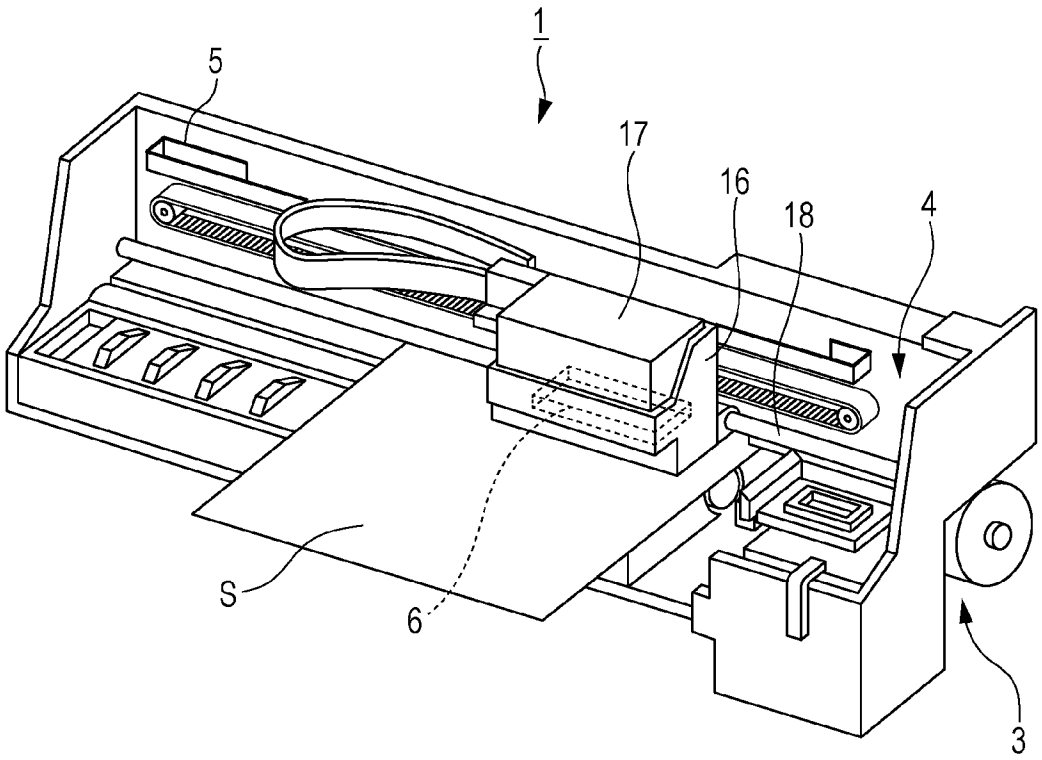
FIG. 2 is a perspective view illustrating an example of an internal configuration of a printer.

FIG. 1 is a block diagram that describes an example of an electrical configuration of a printer 1 and FIG. 2 is a perspective view that describes an example of an internal configuration of the printer 1. An external apparatus 2 may be for example, an electronic device such as a computer, a digital camera, a cellular phone, or a mobile data terminal device. The external apparatus 2 is electrically connected to the printer 1 with either a wired or wireless connection, and sends printing data that depends on an image or text to the printer 1 in order to print the image or the like on a recording medium S such as recording paper in the printer 1.

The printer 1 may include a printing engine 13 such as a paper delivery mechanism 3, a carriage movement mechanism 4, a linear encoder 5, and a recording head 6, and a printer controller 7. The recording head 6, as illustrated in FIG. 2, is attached to a bottom surface side of a carriage 16 on which ink cartridges 17 (liquid supply sources) are mounted. Further, the carriage 16 is configured to be capable of reciprocating movement along a guide rod 18 using the carriage movement mechanism 4. That is, the printer 1 sequentially transports the recording medium S (a kind of landing target or recording medium) such as recording paper using the paper delivery mechanism 3, and lands ink on the recording medium S by ejecting the ink from nozzles 25 (refer to FIG. 3) of the recording head 6. The ink lands on the recording medium S while the printer 1 relatively moves the recording head 6 with respect to the recording medium S in a width direction (a main scanning direction) of the recording medium S, thereby recording images or the like. Additionally, it is possible to adopt a configuration in which the ink cartridges are disposed on a main body side of the printer, and ink from the ink cartridges is delivered to a recording head side through supply tubes.

Returning to FIG. 1, the printer controller 7 may be a control unit that performs the control of the various units of the printer 1. The printer controller 7 may include an interface (I/F) unit 8, a control unit 9, a storage unit 10 and a drive signal generator 11 (corresponding to the drive signal generator of the present invention). The interface unit 8 performs the transmission and reception of status data of the printer 1 when printing data or printing commands are sent from the external apparatus 2 to the printer 1, status information of the printer 1 is output to the external apparatus 2 or the like. The control unit 9 can be an arithmetic processing unit for performing overall control of the printer 1. The storage unit 10 can be an element that stores programs of the control unit 9 and data that is used in various controls. The storage portion 10 can include ROM, RAM and/or NVRAM (non-volatile storage elements). The control unit 9 controls each unit according to the programs that are stored in the storage unit 10.

In addition, the control unit 9 can generate ejection data, which indicates from which nozzles 25 and at what timing to eject ink during a recording action, based upon image data from the external apparatus 2. The control unit 9 can then send the ejection data to a head control unit 15 of the recording head 6.

The drive signal generator 11 generates an analog signal on the basis of waveform data that is related to a waveform of a drive signal. In addition, the drive signal generator 11 generates a drive signal COM such as that shown in FIGS. 4A and 4B by amplifying the signal.

Next, the printing engine 13 will be described. As shown in FIG. 1, the printing engine 13 is provided with the paper delivery mechanism 3, the carriage movement mechanism 4, the linear encoder 5, the recording head 6 and the like. The carriage movement mechanism 4 can include the carriage 16 to which the recording head 6 is attached (which is a type of liquid ejecting head), a drive motor (for example, a DC motor), which causes the carriage 16 to travel using a timing belt or the like, and causes the recording head 6 that is mounted to the carriage 16 to move in a main scanning direction. The paper delivery mechanism 3 includes a paper delivery motor, a paper delivery roller and the like, and performs sub scanning by sequentially sending recording medium S out onto a platen. In other words, the paper delivery mechanism 3 may move the recording medium in the sub-scan direction at certain times. In addition, the linear encoder 5 outputs an encoder pulse that depends on a scanning position of the recording head 6 mounted to the carriage 16, to the printer controller 7 as position information in the main scanning direction. The control unit 9 of the printer controller 7 can ascertain or determine the scanning position (current position) of the recording head 6 on the basis of the encoder pulse that is received from the linear encoder 5 side. In addition, the control unit 9 generates a timing signal (e.g., latch signal), which defines a generation timing of a drive signal COM (to be described later), on the basis of the encoder pulse.

Figure 3:
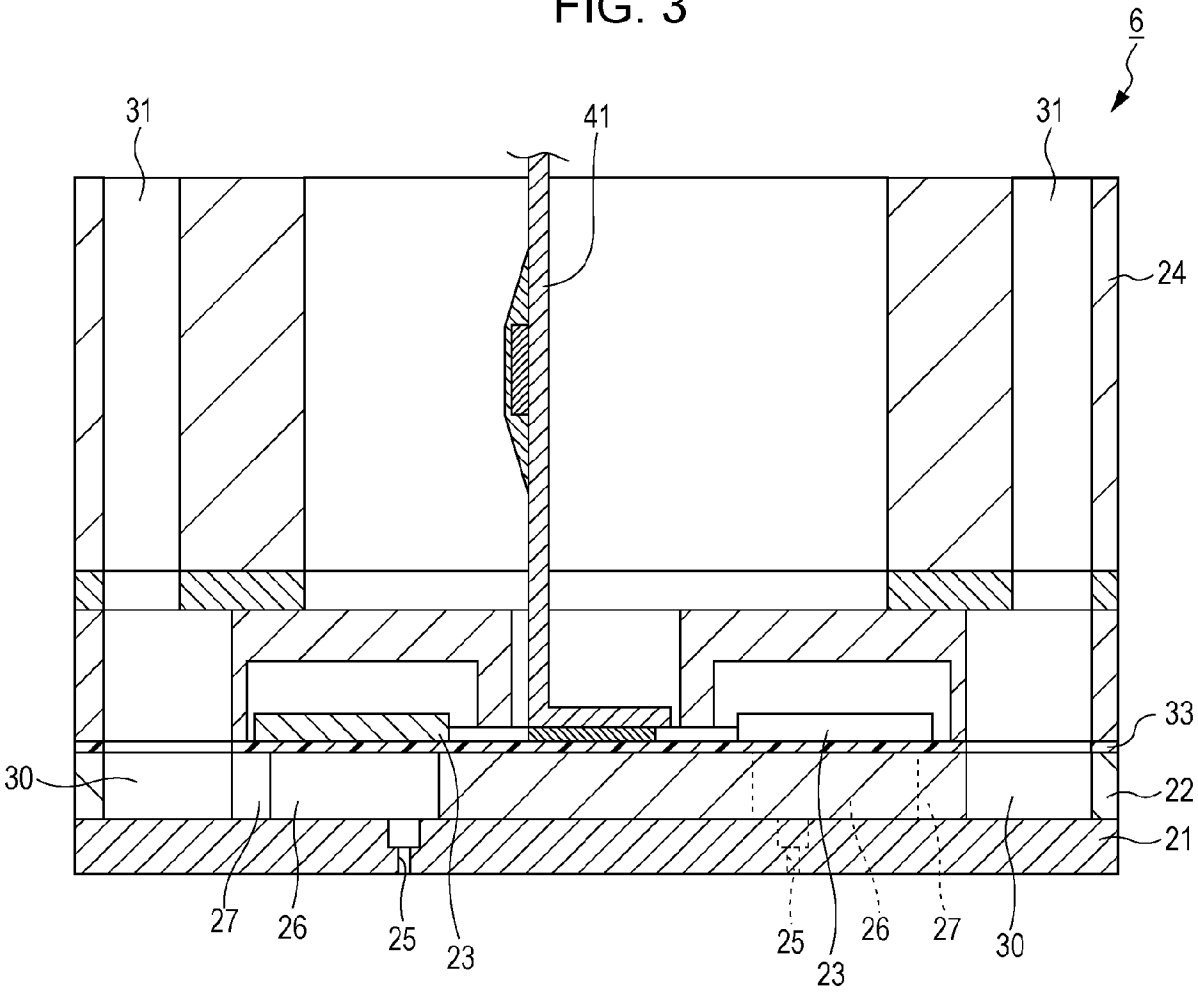
FIG. 3 is a cross-sectional view illustrating an example of a configuration of a recording head.

FIG. 3 is a main portion cross-sectional view illustrating an example of an internal configuration of the recording head 6.

The recording head 6 of the present embodiment includes members such as a nozzle plate 21, a flow channel substrate 22, a piezoelectric element 23 and the like, and is attached to a case 24 in a state in which these members are stacked or laminated. The nozzle plate 21 is a plate-shaped member in which a plurality of nozzles 25 are provided or formed in row form in an open manner with a predetermined pitch. In the present embodiment, two nozzle rows, each of which is configured from the plurality of nozzles 25, are arranged in parallel in the nozzle plate 21.

The flow channel substrate 22 is a plate material that is formed from a silicon monocrystalline substrate or the like, in one example. A plurality of pressure chambers 26 are formed in the flow channel substrate 22 lined up in a nozzle row direction. In this configuration, rack pressure chamber 26 is provided on a one-to-one basis to correspond to each nozzle 25 of the nozzle plate 21. That is, the pitch of each pressure chamber 26 corresponds to the pitch of the nozzles 25.

In the present embodiment, two pressure chamber rows are provided to correspond to the two nozzle rows. In addition, reservoirs 30 that penetrate through the flow channel substrate 22 are formed along a parallel arrangement direction of the pressure chambers 26 in a region that is separated from a side that is opposite a communication side of the nozzle 25 with the pressure chamber 26. In one example, the pressure chambers 26 may be at least partly located between the nozzle 25 and the reservoir 30. The reservoir 30 is an empty or hollow part that is common to each pressure chamber 26 that belongs to the same pressure chamber row. The reservoirs 30 and each pressure chamber 26 are respectively in communication with one another via ink supply openings 27 that are formed with a width that is narrower than that of the pressure chambers 26. Each pressure chamber 26 is associated with an ink supply port 27. Additionally, ink from an ink cartridge 17 side is introduced into the reservoirs 30 through ink supply channels 31 of the case 24.

The nozzle plate 21 is joined to a bottom surface (a surface that is opposite a piezoelectric element 23 side) of the flow channel substrate 22 using an adhesive, a heat welding film, or the like. The nozzle plate 21 is a plate material in which the plurality of nozzles 25 are provided or formed in row form in an open manner with a predetermined pitch. In the present embodiment, and by way of example only, a nozzle row is configured by lining up 360 nozzles 25 at a pitch that corresponds to 360 dpi. Each nozzle 25 is in communication with the pressure chamber 26 at an end part of a side of the pressure chamber 26 that is opposite the ink supply opening 27. Additionally, the nozzle plate 21 is for example, formed from glass ceramics, a silicon monocrystalline substrate, stainless steel or the like. In the recording head 6 of the present embodiment, a total of two nozzle rows are provided, and a liquid flow channel that corresponds to each nozzle row is provided in a bilaterally symmetrical manner with the nozzle 25 side on the inside thereof.

The piezoelectric element 23 is formed on an upper surface of a side that is opposite a nozzle plate 21 side of the flow channel substrate 22 via an elastic film 33 (the piezoelectric element 23 is on one side of the flow channel substrate 22 and the nozzle plate 21 is on the other or opposite side of the flow channel substrate). That is, an opening of an upper part of each pressure chamber 26 is blocked by the elastic film 33, and the piezoelectric element 23 is further formed thereon. The piezoelectric element 23 is formed by sequentially laminating a lower electrode film made of metal or other suitable conductive material, a piezoelectric body layer (a piezoelectric body film) in which a piezoelectric body is formed in film-shape, and an upper electrode film that is formed from metal or other suitable conductive material. In this example, the crystal is oriented as the piezoelectric body layer. For example, in the present embodiment, a piezoelectric body layer that is used is one in which the crystal is oriented by forming using a so-called sol-gel method that obtains a piezoelectric body layer that is formed from a metal oxide by applying and drying, then gelatinizing a so-called sol in which a metal organic material has been dissolved or dispersed in a catalyst, and further firing the product at a high temperature. A lead zirconate titanate material is one example of a material of the piezoelectric body layer in a case of use in an ink jet type recording head. Additionally, the film formation method of the piezoelectric body layer is not particularly limited, and for example, the piezoelectric body layer may be formed by a sputtering method. In addition, the film formation method may use a method that grows crystals in an aqueous alkali solution at a low temperature using a high pressure treatment method after forming a lead zirconate titanate precursor film using a sol-gel method, a sputtering method or the like.

Regardless of the method used, in a piezoelectric body layer that is formed in this manner, different to so-called bulk piezoelectric bodies, crystals are preferentially oriented, and in the present embodiment, crystals are formed in pillar form in the piezoelectric body layer. Additionally, as mentioned herein preferential orientation refers to a state in which a specific crystal surface is arranged in a substantially constant direction rather than the orientation direction of crystals being disordered. In addition, a thin film with pillar-shaped crystals refers a state in which a thin film is formed by aggregation of substantially cylindrical crystals formed by aggregation over a surface direction in a state in which the central axes thereof are substantially uniform in a thickness direction. Naturally, a thin film that is formed by preferentially oriented granular crystals may also be used. Additionally, the thickness of a piezoelectric body layer that is produced with this kind of a thin film step is generally 0.5 to 5 μm.

Figure 6:
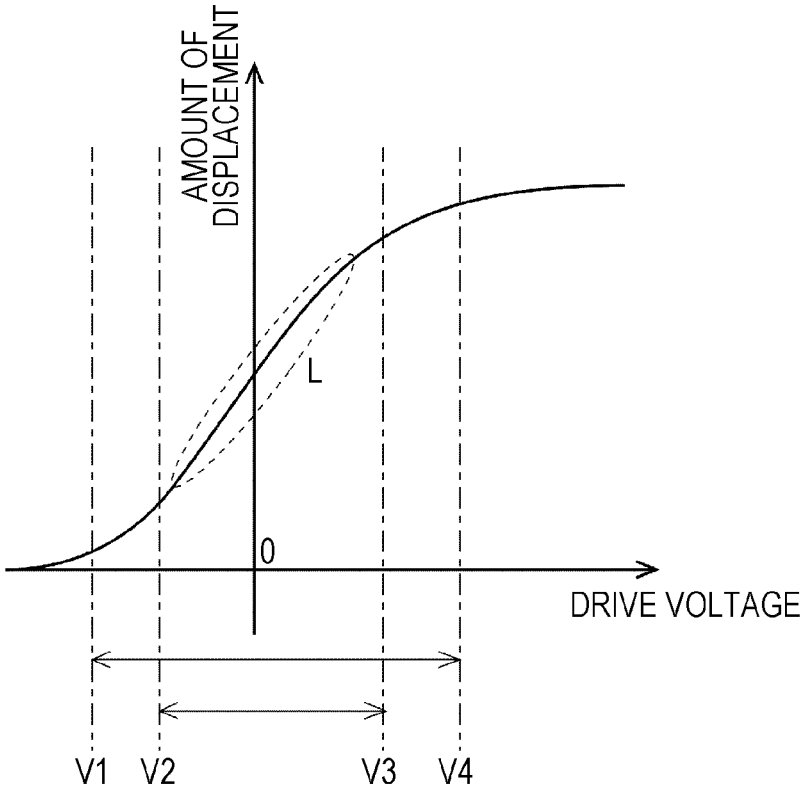
FIG. 6 is a characteristic diagram that shows a relationship between a drive voltage and an amount of displacement of a piezoelectric body.
Figure 7A:
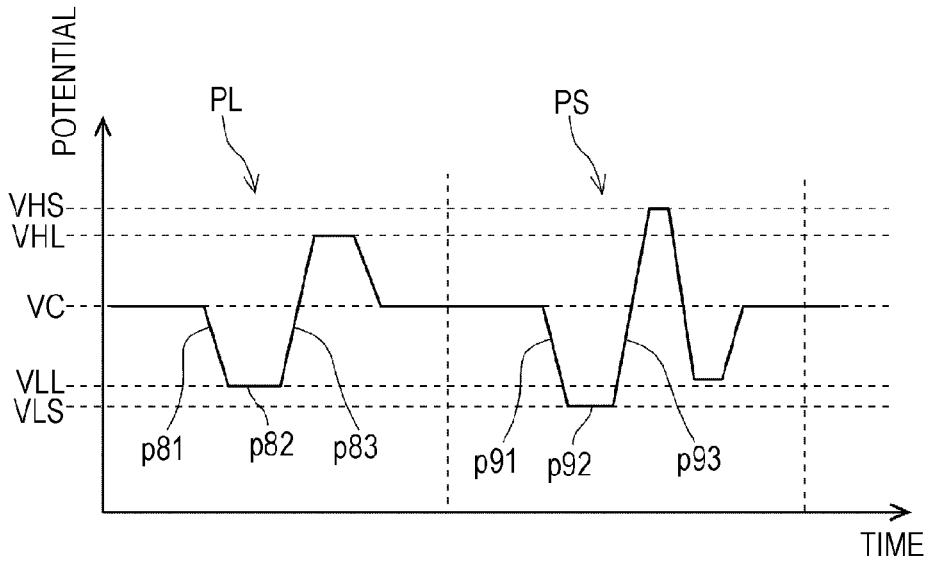
FIGS. 7A and 7B are schematic diagrams that describe a configuration of a drive signal of the related art.
Figure 7B:
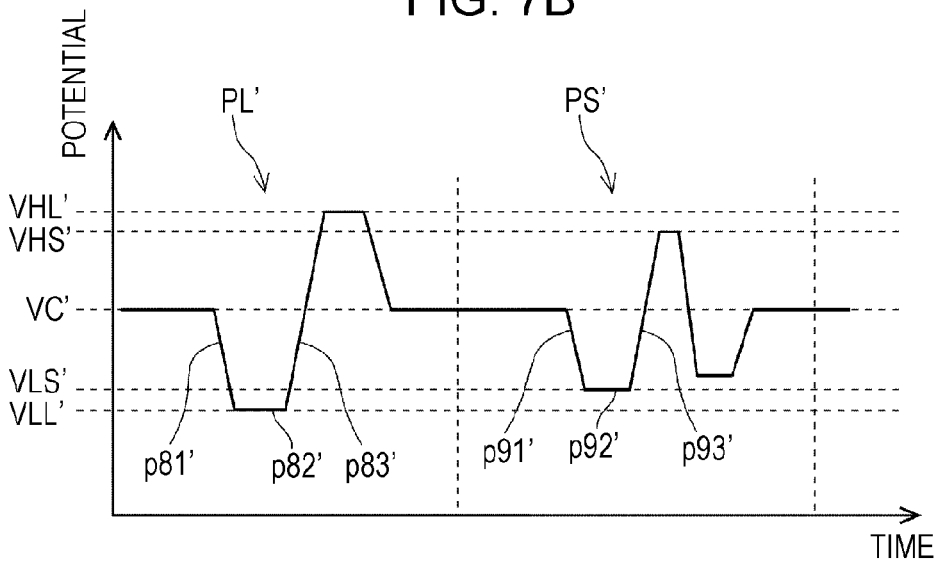

A piezoelectric body layer (a piezoelectric element 23) that is formed in this manner deforms due to the drive signal COM being applied thereto through a wiring member 41. More specifically, if a constant common potential is applied to a common electrode, and an oscillatory waveform is applied to an individual electrode, an electrical field that depends on a difference in potential is brought about between the two electrodes. The piezoelectric body layer bends and deforms depending on the intensity of the electrical field. FIG. 6 shows an example of piezoelectric properties of the piezoelectric body layer. Additionally, the horizontal axis of FIG. 6 represents a drive voltage (a difference in potential between the upper electrode film and the lower electrode film) that is applied to the piezoelectric body layer, and the vertical axis thereof represents an amount of displacement from a standard position of the piezoelectric body layer. As shown in FIG. 6, in the piezoelectric properties of the piezoelectric body layer in the present embodiment, there is a linear region L in the vicinity of where the drive voltage is 0, in which the properties change in substantially linear form from partway through negative drive voltages to partway through positive drive voltages (a portion that is enclosed by a dashed line in FIG. 6). Regions of drive voltages that are further on the negative side or the positive side than the linear region L are non-linear regions in which the ratio of the amount of displacement with respect to the drive voltage becomes gradually smaller.

The piezoelectric body layer, that is, the piezoelectric element 23 bends and deforms depending on piezoelectric properties such as those mentioned above. That is, the higher the drive voltage (an application voltage) is set, the more a central portion of the piezoelectric body layer bends toward a side that approaches the nozzle plate 21, and deforms the elastic film 33 so as to reduce the capacity of the pressure chamber 26. On the other hand, the lower the drive voltage is set, the more a central portion of the piezoelectric body layer bends toward a side that becomes separated from the nozzle plate 21, and deforms the elastic film 33 so as to increase the capacity of the pressure chamber 26. In this manner, since the capacity of the pressure chamber 26 changes when the piezoelectric element 23 is driven, the pressure of ink inside the pressure chamber 26 changes depending on this change. Further, it is possible to cause ink droplets to be ejected from the nozzles 25 by controlling this pressure change (pressure fluctuation) in the ink.

Next, an example electrical configuration of the recording head 6 will be described.

As shown in FIG. 1, the recording head 6 has a latch circuit 36, a decoder 37, a switch 38, and the piezoelectric element 23. The latch circuit 36, the decoder 37 and the switch 38 form the head control unit 15, and the head control unit 15 is provided for each piezoelectric element 23, that is, for each nozzle 25. The latch circuit 36 latches ejection data on the basis of print data. The ejection data is data that controls ejection and non-ejection of ink from each nozzle 25. In other words, the ejection pattern data, such as dot pattern data, is used to control which nozzles eject ink and which nozzles do not eject ink. The decoder 37 outputs a switch control signal that controls the switch 38 on the basis of the ejection data that is latched by the latch circuit 36. The switch control signal that is output from the decoder 37 is input to the switch 38. The switch 38 is a switch that is turned on and off depending on the switch control signal.

Figure 4A:
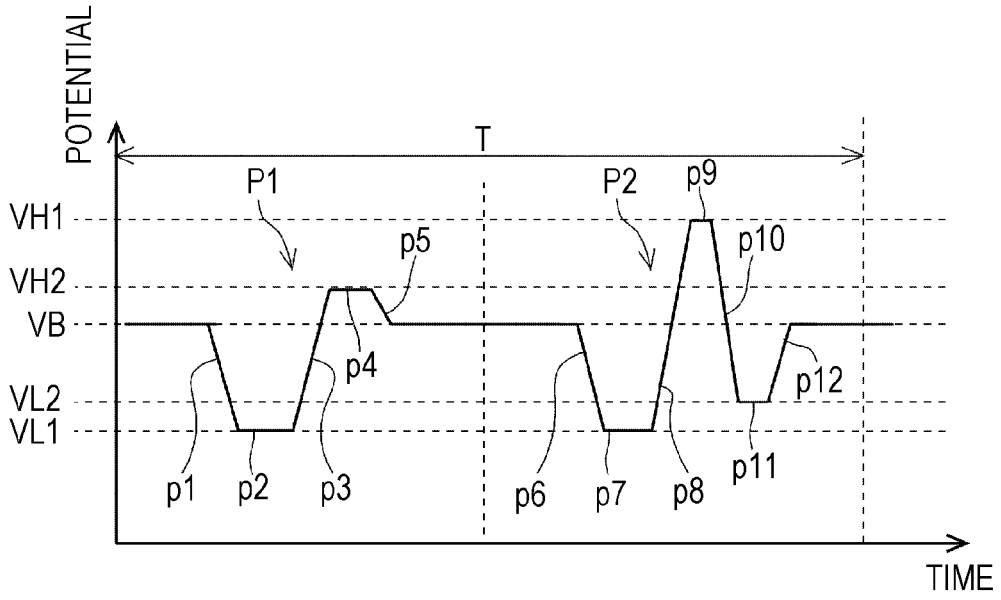
FIGS. 4A and 4B are waveform charts illustrating an example of a configuration of a drive signal.

FIG. 4A is an example waveform chart that describes a configuration of a drive signal COM (an oscillatory waveform). Additionally, in FIG. 4A, the vertical axis represents potential, and the horizontal axis represents time. In the present embodiment, when the recording head 6 performs the ejection of ink while moving relatively with respect to the recording medium S, a unit period T, which is a repeating period of the drive signal COM, corresponds to a period of time in which the nozzle 25 moves by a distance that corresponds to a width of a pixel, which is a constitutional unit of an image. The unit period T may be repeated multiple times while the recording head is moved, for example, in the main scan direction. The drive signals COM are generated depending on a latch signal, which is a timing signal that is generated on the basis of an encoder pulse that depends on the scanning position of the recording head 6. Therefore, the drive signal COM is a signal that is generated at a period that is stipulated by the latch signal.

The printer 1 in the present embodiment is capable of multi-gradation recording that forms dots of different sizes on the recording medium S The printer 1 can perform, by way of example, a recording action with relatively large dots and relatively small dots. That is, the drive signal COM is a signal that generates a first drive pulse P1 that causes ink droplets to be ejected from the nozzles 25 and a second drive pulse P2 that causes ink droplets that are smaller than those of the first drive pulse P1 to be ejected from the nozzles 25 in this order. In other words, the driving signal COM is selectively applied to each piezoelectric element 23 during a printing process to allow a variety of sized dots to be recorded on the recording medium S.

The first drive pulse P1 is configured from a first expansion element p1, a first expansion retention element p2, a first contraction element p3, a first contraction retention element p4 and a first expansion reversion element p5. The first expansion element p1 is an element that causes the pressure chamber 26 to expand from a standard capacity by changing from a standard potential VB, which is a standard for changes in potential, to a first expansion potential VL1 (the lowest potential). The first expansion retention element p2 is an element that retains the expanded pressure chamber 26 for a set period of time by retaining the first expansion potential VL1. The first contraction element p3 is an element that causes the expanded pressure chamber 26 to contract by changing from the first expansion potential VL1 to a first contraction potential VH2 (in the present embodiment, a potential that is higher than the standard potential VB, but lower than a second contraction potential VH1 (the highest potential)) that differs from the standard potential, thereby causing ink to be ejected. The first contraction retention element p4 is an element that retains the contracted pressure chamber 26 for a set period of time by retaining the first contraction potential VH2. The first expansion reversion element p5 is an element that causes the contracted pressure chamber 26 to revert to the standard capacity by changing from the first contraction potential VH2 to the standard potential VB.

When this kind of first drive pulse P1 is applied to a piezoelectric element 23, ink droplets that are larger than those of the second drive pulse P2 are ejected from the nozzle 25. More specifically, firstly, when the first expansion element p1 is applied, a meniscus that is exposed in the nozzle 25 is drawn in toward the pressure chamber 26 side. This state is retained by the first expansion retention element p2. Subsequently, when the first contraction element p3 is applied, the pressure chamber 26 is contracted suddenly, and the pressure of ink inside the pressure chamber 26 is increased. As a result of this, a relatively large amount of ink droplets are ejected from the nozzle 25. Thereafter, the pressure chamber 26 is reverted to the standard capacity by sequentially applying the first contraction retention element p4 and the first expansion reversion element p5. Different volumes of ink droplets could be ejected by configuring the driving pulse differently.

Turning to the second drive pulse P2, in the presently illustrated embodiment, the second drive pulse P2 is configured from a second expansion element p6, a second expansion retention element p7, a second contraction element p8, a second contraction retention element p9, a second reexpansion element p10, a second reexpansion retention element p11 and a second contraction reversion element p12. The second expansion element p6 is an element that causes a pressure chamber 26 to expand from a standard capacity by changing from a standard potential VB, which is a standard for changes in potential, to a second expansion potential VL1 (the lowest potential) that is the same potential as the first expansion potential VL1. The second expansion retention element p7 is an element that retains the expanded pressure chamber 26 for a set period of time by retaining the second expansion potential VL1. The second contraction element p8 is an element that causes the expanded pressure chamber 26 to contract by changing from the second expansion potential VL1 to a second contraction potential VH1 (the highest potential), thereby causing ink to be ejected. The second contraction retention element p9 is an element that retains the contracted pressure chamber 26 for a set period of time by retaining the second contraction potential VH1. The second reexpansion element p10 is an element that causes the contracted pressure chamber 26 to expand again by changing from the second contraction potential VH1 to a second reexpansion potential VL2 that is lower than the standard potential VB, but higher than the second expansion potential VL1. The second reexpansion retention element p11 is an element that retains the expanded pressure chamber 26 for a set period of time by retaining the second reexpansion potential VL2. The second contraction reversion element p12 is an element that causes the expanded pressure chamber 26 to revert to the standard capacity by changing from the second reexpansion potential VL2 to the standard potential VB.

When this kind of second drive pulse P2 is applied to a piezoelectric element 23, ink droplets that are smaller than those of the first drive pulse P1 are ejected from the nozzle 25. More specifically, firstly, when the second expansion element p6 is applied, a meniscus that is exposed in the nozzle 25 is drawn in toward the pressure chamber 26 side. This state is retained by the second expansion retention element p7. Subsequently, when the second contraction element p8 is applied, the pressure chamber 26 is contracted suddenly, and the pressure of ink inside the pressure chamber 26 is increased. As a result of this, ink in a central portion of the meniscus has a tendency to stretch in pillar form toward an ejection direction due to inertia. At this time, since the second reexpansion element p10 is applied after a contracted state of the pressure chamber 26 has been retained by the second contraction retention element p9, the pressure chamber 26 expands again, and the meniscus is drawn in a direction that is opposite a direction in which the ink has a tendency to extend. As a result of this, it becomes likely that a tip portion of an ink pillar will be cut off, and a relatively small amount of ink droplets are ejected. Thereafter, the pressure chamber 26 is reverted to the standard capacity by sequentially applying the second reexpansion retention element p11 and the second contraction reversion element p12.

In this manner, in the presently described embodiment, a difference in potential of the second contraction element p8 in the second drive pulse P2 (a difference in potential between the second expansion potential VL1 and the second contraction potential VH1) is set so as to be larger than a difference in potential of the first contraction element p3 in the first drive pulse P1 (a difference in potential between the first expansion potential VL1 and the first contraction potential VH2). In addition, the VL1, which is the first expansion potential of the first drive pulse P1 and an initiation potential or starting potential of the first contraction element p3, and the VL1, which is the second expansion potential of the second drive pulse P2 and an initiation potential or starting potential of the second contraction element p8, are made or set to be uniform at the same potential. Stated another way, the initiation potential of both the first contraction element p3 and the second contraction element p8 have the same potential. Additionally, in the present embodiment, the standard potential VB is made to be uniform or the same as an intermediate potential (an intermediate potential of the second expansion potential VL1 and the second contraction potential VH1) of the second drive pulse P2.

Further, in a case in which the piezoelectric body layer has, for example, piezoelectric properties such as those shown in FIG. 6, the expansion potentials VL1 (the initiation potentials VL1 of the contraction elements p3 and p8 that cause ink to be ejected) of both of the drive pulses P1 and P2 are made to match the intended drive voltage V1 in the piezoelectric properties in FIG. 6. The drive voltage V1 is a value in the piezoelectric properties that is within an ideal range (not limited to the linear region L) that is capable of efficiently expanding and contracting the pressure chamber 26 as quickly as possible with both of the drive pulses P1 and P2. As a result of this, it is possible to set the ejecting properties of ink droplets that are ejected using both of the drive pulses P1 and P2 to optimal properties that match the piezoelectric properties of the piezoelectric body. That is, since the expansion potentials VL1 (the initiation potentials VL1 of the contraction elements p3 and p8 that cause ink to be ejected) are made to be uniform with the intended drive voltage V1 in cases in which the standard potential VB (an intermediate potential of the second drive pulse P2) is increased or decreased in order to adjust the amount of ink droplets that are ejected using one drive pulse, it is possible to suppress a circumstance in which the driving of the piezoelectric body using both of the drive pulses P1 and P2 deviates from optimum driving conditions. As a result of this, it is possible to suppress a circumstance in which the ink droplets that are ejected using both of the drive pulses P1 and P2 are ejected with conditions that deviate from optimal conditions. In addition, if a range of changes in potential (a range from the highest potential to the lowest potential) of both of the drive pulses P1 and P2 is set to include the linear region L, it is possible to drive the piezoelectric element 23 using the maximum amount of the linear region L. Furthermore, since it is possible to use the maximum amount of the linear region L in which the ratio of the amount of displacement with respect to the drive voltage is large in both of the drive pulses P1 and P2, it is possible to eject ink droplets efficiently. As a result of this, it is possible to keep a ratio of changes in potential due to the contraction elements p3 and p8 down. Additionally, the piezoelectric properties of the piezoelectric body layer are not limited to the properties that are shown in FIG. 6, and various properties are possible, but regardless of the properties that are used, the expansion potentials VL1 of both of the drive pulses P1 and P2, that is, the initiation potentials VL1 of the contraction elements p3 and p8 that cause ink to be ejected, are made to match the intended drive voltage in the piezoelectric properties.

Figure 4B:
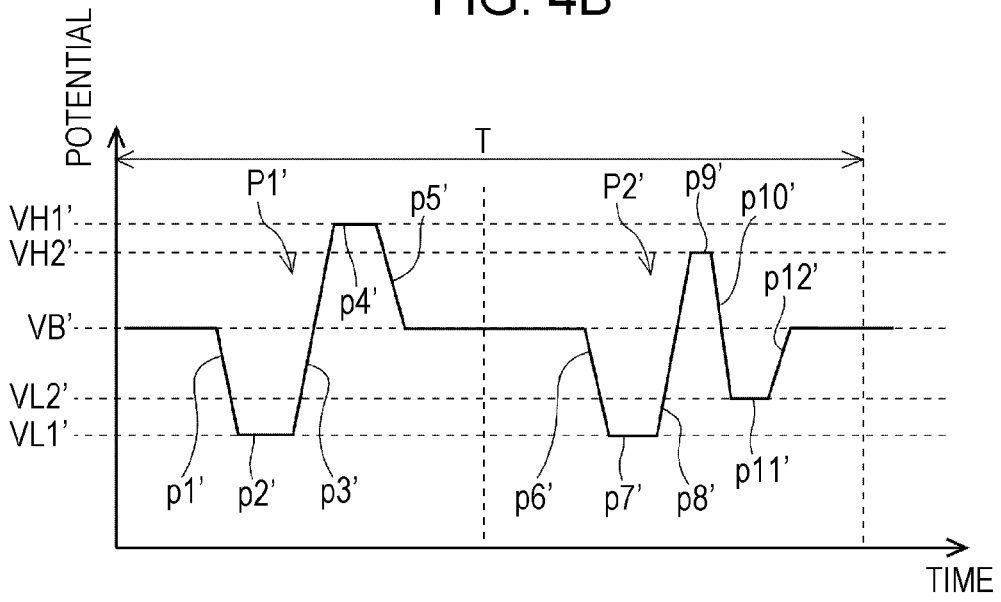

Incidentally, in the drive signal COM that is shown in FIG. 4A, the difference in potential of the second contraction element p8 of the second drive pulse P2 is set to be greater than the difference in potential of the first contraction element p3 of the first drive pulse P1, but the drive signal COM is not limited thereto. In the drive signal COM that is shown in FIG. 4B, the difference in potential of the first contraction element p3' of the first drive pulse P1' is set to be greater than the difference in potential of the second contraction element p8' of the second drive pulse P2'. Additionally, an amount of ink droplets that is ejected using the first drive pulse P1' is also greater than an amount of ink droplets that is ejected using the second drive pulse P2' in the drive signal COM that is shown in FIG. 4B.

More specifically, the first drive pulse P1' of the illustrated embodiment is configured from a first expansion element p1', a first expansion retention element p2', a first contraction element p3', a first contraction retention element p4' and a first expansion reversion element p5'. The first expansion element p1' is an element that causes a pressure chamber 26 to expand from a standard capacity by changing from a standard potential VB', which is a standard for changes in potential, to a first expansion potential VL1' (the lowest potential). The first expansion retention element p2' is an element that retains the expanded pressure chamber 26 for a set period of time by retaining the first expansion potential VL1'. The first contraction element p3' is an element that causes the expanded pressure chamber 26 to contract by changing from the first expansion potential VL1' to a first contraction potential VH1' (the highest potential) that differs from the standard potential, thereby causing ink to be ejected. The first contraction retention element p4' is an element that retains the contracted pressure chamber 26 for a set period of time by retaining the first contraction potential VH1'. The first expansion reversion element p5' is an element that causes the contracted pressure chamber 26 to revert to the standard capacity by changing from the first contraction potential VH1' to the standard potential VB'.

In addition, the second drive pulse P2' is configured from a second expansion element p6', a second expansion retention element p7', a second contraction element p8', a second contraction retention element p9', a second reexpansion element p10', a second reexpansion retention element p11' and a second contraction reversion element p12'. The second expansion element p6' is an element that causes a pressure chamber 26 to expand from a standard capacity by changing from a standard potential VB', which is a standard for changes in potential, to a second expansion potential VL1' (the lowest potential) that is the same potential as the first expansion potential VL1'. The second expansion retention element p7' is an element that retains the expanded pressure chamber 26 for a set period of time by retaining the second expansion potential VL1'. The second contraction element p8' is an element that causes the expanded pressure chamber 26 to contract by changing from the second expansion potential VL1' to a second contraction potential VH2' that is higher than the standard potential VB', but lower than the first contraction potential VH1' (the highest potential), thereby causing ink to be ejected. The second contraction retention element p9' is an element that retains the contracted pressure chamber 26 for a set period of time by retaining the second contraction potential VH2'. The second reexpansion element p10' is an element that causes the contracted pressure chamber 26 to expand again by changing from the second contraction potential VH2' to a second reexpansion potential VL2' that is lower than the standard potential VB', but higher than the second expansion potential VL1'. The second reexpansion retention element p11' is an element that retains the expanded pressure chamber 26 for a set period of time by retaining the second reexpansion potential VL2'. The second contraction reversion element p12' is an element that causes the expanded pressure chamber 26 to revert to the standard capacity by changing from the second reexpansion potential VL2' to the standard potential VB'. In the present embodiment, the standard potential VB' is made to be uniform or the same as an intermediate potential (an intermediate potential of the first expansion potential VL1' and the first contraction potential VH1') of the first drive pulse P1'.

In the presently described embodiment, the expansion potentials VL1' of both of the drive pulses P1' and P2', that is, the initiation or starting potentials VL1' of the contraction elements p3' and p8' that cause ink to be ejected, are also made to match the intended drive voltage in the piezoelectric properties of the piezoelectric body layer. As a result of this, it is possible to set the ejecting properties of ink droplets that are ejected using both of the drive pulses P1' and P2' to optimal properties that match the piezoelectric properties of the piezoelectric body. Additionally, since other configurations are the same as those of the abovementioned embodiment, description thereof has been omitted.

Figure 5:
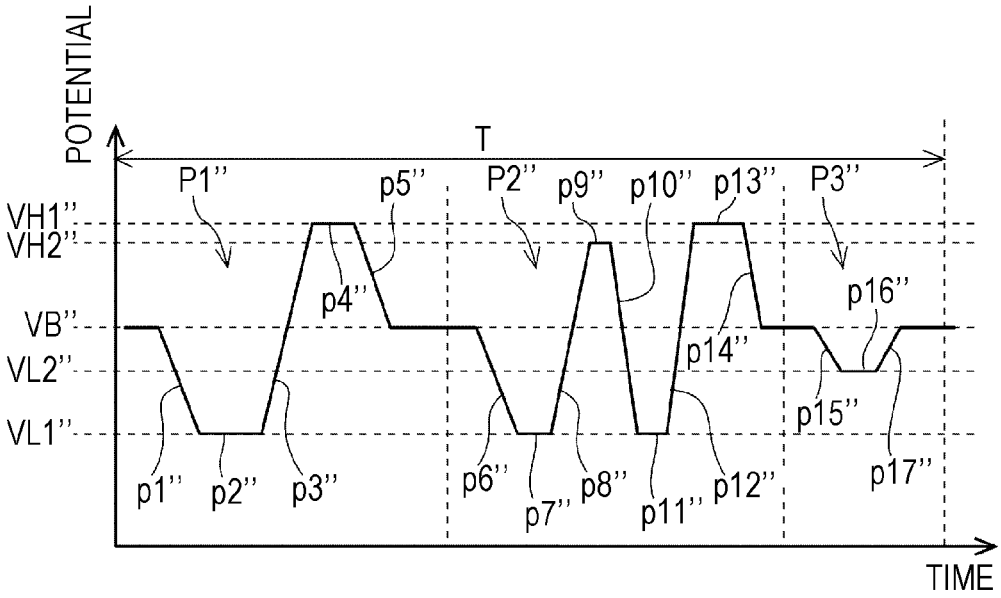
FIG. 5 is a waveform chart illustrating an example of another configuration of a drive signal in another embodiment.

Incidentally, the configuration of the drive signal COM (the drive pulses) is not limited to that mentioned above, and it is possible to adopt various configurations provided the initiation or start potential of the contraction elements that cause ink to be ejected are made or set to be uniform or have the same potential for each drive pulse. For example, FIG. 5 shows a configuration of a drive signal COM in another embodiment. Additionally, in the drive signal COM that is shown in FIG. 5, an amount of ink droplets that is ejected using the first drive pulse P1" is greater than an amount of ink droplets that is ejected using the second drive pulse P2". In addition, the drive signal COM is provided with an aperiodic pulse P3" after the second drive pulse P2' in the unit period T.

A first drive pulse P1" of the present embodiment is configured from a first expansion element p1", a first expansion retention element p2", a first contraction element p3", a first contraction retention element p4" and a first expansion reversion element p5". The first expansion element p1" is an element that causes a pressure chamber 26 to expand from a standard capacity by changing from a standard potential VB", which is a standard for changes in potential, to a first expansion potential VL1" (the lowest potential). The first expansion retention element p2" is an element that retains the expanded pressure chamber 26 for a set period of time by retaining the first expansion potential VL1". The first contraction element p3" is an element that causes the expanded pressure chamber 26 to contract by changing from the first expansion potential VL1" to a first contraction potential VH1" (the highest potential) that differs from the standard potential, thereby causing ink to be ejected. The first contraction retention element p4" is an element that retains the contracted pressure chamber 26 for a set period of time by retaining the first contraction potential VH1". The first expansion reversion element p5" is an element that causes the contracted pressure chamber 26 to revert to the standard capacity by changing from the first contraction potential VH1" to the standard potential VB".

In addition, the second drive pulse P2" is configured from a second expansion element p6", a second expansion retention element p7", a second contraction element p8", a second contraction retention element p9", a second reexpansion element p10", a second reexpansion retention element p11", a second recontraction element p12", a second recontraction retention element p13" and a second expansion reversion element p14". The second expansion element p6" is an element that causes a pressure chamber 26 to expand from a standard capacity by changing from a standard potential VB", which is a standard for changes in potential, to a second expansion potential VL1" (the lowest potential) that is the same potential as the first expansion potential VL1". The second expansion retention element p7" is an element that retains the expanded pressure chamber 26 for a set period of time by retaining the second expansion potential VL1". The second contraction element p8" is an element that causes the expanded pressure chamber 26 to contract by changing from the second expansion potential VL1" to a second contraction potential VH2" that is higher than the standard potential VB", but lower than the second contraction potential VH1" (the first contraction potential VH1"), thereby causing ink to be ejected. The second contraction retention element p9" is an element that retains the contracted pressure chamber 26 for a set period of time by retaining the second contraction potential VH2". The second reexpansion element p10" is an element that causes the contracted pressure chamber 26 to expand again by changing from the second contraction potential VH2" to a second reexpansion potential VL1". The second reexpansion retention element p11" is an element that retains a reexpanded pressure chamber 26 for a set period of time by retaining the second reexpansion potential VL1" for a set period of time. The second recontraction element p12" is an element that causes the expanded pressure chamber 26 to contract again by changing from the second reexpansion potential VL1" to a second recontraction potential VH1". The second recontraction retention element p13" is an element that retains a recontracted pressure chamber 26 for a set period of time by retaining the second recontraction potential VH1" for a set period of time. The second expansion reversion element p14" is an element that causes the contracted pressure chamber 26 to revert to the standard capacity by changing from the second recontraction potential VH1" to the standard potential VB".

Furthermore, the aperiodic pulse P3" is a drive pulse that is set to a waveform that is capable of causing a meniscus to vibrate to a degree at which ink is not ejected from the nozzle 25 in order to suppress the thickening of ink in the nozzle 25. More specifically, the aperiodic pulse P3" is configured from an aperiodic expansion element p15", an aperiodic expansion retention element p16" and an aperiodic reversion element p17". The aperiodic expansion element p15" is an element that causes a pressure chamber 26 to expand from a standard capacity to a slightly larger aperiodic expansion capacity by changing from a standard potential VB", which is a standard for changes in potential, to an aperiodic expansion potential VL2" that is higher than the second expansion potential VL1". The aperiodic expansion retention element p16" is an element that retains the expanded pressure chamber 26 for a set period of time by retaining the aperiodic expansion potential VL2". The aperiodic reversion element p17" is an element that causes a pressure chamber 26 that has expanded to the aperiodic expansion capacity to revert to the standard capacity by changing from the aperiodic expansion potential VL2" to the standard potential VB".

In the presently illustrated embodiment of FIG. 5, the initiation potentials VL1" of the contraction elements p3" and p8" that cause ink to be ejected, which are the expansion potentials of the drive pulses P1" and P2" are also made to match the intended drive voltage. As a result of this, it is possible to set the ejecting properties of ink droplets that are ejected using both of the drive pulses P1" and P2" to optimal properties that match the piezoelectric properties of the piezoelectric body. Additionally, it is possible to set other potentials in each drive pulse P1" and P2" as appropriate, provided the initiation potentials VL1 of the contraction elements p3" and p8", which are the expansion potentials, that cause ink to be ejected are made to be uniform or the same. In addition, since other configurations are the same as those of the abovementioned embodiment, description thereof has been omitted.

In addition, it is possible to adopt various configurations as the configuration of the drive pulses. In brief, a drive pulse of any configuration may be used as long as the drive pulse is provided with an expansion element that causes a pressure chamber 26 to expand by changing from the standard potential to an expansion potential and a contraction element that causes a pressure chamber 26 to contract, thereby ejecting ink and is capable of causing ink to be ejected from a nozzle 25. In addition, the number of drive pulses that are included in the drive signal COM is not limited to two, and it is possible to include a plurality of drive pulses therein. For example, it is possible to include a large dot drive pulse that causes ink that corresponds to large dots to be ejected, a medium dot drive pulse that causes ink that corresponds to medium dots to be ejected, and a small dot drive pulse that causes ink that corresponds to small dots to be ejected in a unit period T of a drive signal COM. In a case of such a drive signal COM, since the size of the dots differs greatly, it is likely a range of changes in potential of the drive signal COM (a range from the highest potential to the lowest potential) differs for each drive pulse. Therefore, in the related art, when the driving of the piezoelectric body by a single drive pulse was optimized by increasing or decreasing the standard potential (the intermediate potential), there was a tendency for driving of the piezoelectric body by other drive pulses to deviate from optimal driving conditions. However, in the present invention, since the initiation potentials of the contraction elements that cause ink to be ejected are made to be uniform or the same in each drive pulse, it is possible to suppress a circumstance in which driving of the piezoelectric body by other drive pulses deviates from optimal driving conditions. Additionally, for example, in each of the abovementioned embodiments, it is possible to use the first drive pulse as a large dot drive pulse and the second drive pulse as a small dot drive pulse. In this case, the medium dot drive pulse corresponds to the third drive pulse in the present invention.

In addition, it is possible to use a drive signal COM that is provided with a pulse that is the same as the large dot drive pulse after a large dot drive pulse that causes ink that corresponds to large dots to be ejected, and a small dot drive pulse that causes ink that corresponds to small dots to be ejected. That is, it is possible to apply the present invention to a drive signal COM that is provided with two large dot drive pulses and one small dot drive pulse. In this case, in each of the abovementioned embodiments, it is also possible to use the first drive pulse as a large dot drive pulse, and use the second drive pulse as a small dot drive pulse. Furthermore, in a case of a drive signal COM that is provided with a plurality of drive pulses, it is desirable that all of the expansion potentials of the drive pulses are made to be uniform at the same potential, but it is feasible for the initiation potentials of the contraction elements that cause ink to be ejected of at least two of the drive pulses to be made to be uniform at the same potential.

Further, an ink jet recording apparatus 1 that is provided with an ink jet recording head 6 that is one type of liquid ejecting head has been described above, but it is also possible to apply the present invention to other liquid ejecting head that are configured to bring about pressure fluctuations in a pressure chamber by causing a piezoelectric body to deform, and driving methods for liquid ejecting heads. For example, it is also possible to apply the present invention to liquid ejecting apparatuses that are provided with color material ejecting heads that are used in the production of color filters such as liquid crystal displays, electrode material ejecting heads that are used in electrode formation such as organic EL (Electro Luminescence) displays, FED (Field Emission Displays) and the like, organic material ejecting heads that are used in the production of biochips (biotips) and the like, and driving method of liquid ejecting apparatuses.

What is claimed is:

1. A liquid ejecting apparatus comprising:

a liquid ejecting head having a piezoelectric body that deforms due to a drive signal being applied thereto and a pressure chamber containing a liquid, deformation of the piezoelectric body creating a pressure fluctuation in the liquid inside the pressure chamber to eject liquid droplets from the nozzles; and a drive signal generator that generates the drive signal, wherein the drive signal consists of at least one first drive pulse that causes liquid droplets to be ejected from the nozzles and at least one second drive pulse that causes liquid droplets of a different size to those of the first drive pulse to be ejected from the nozzles, wherein the first and second drive pulses comprise an ejection pulse, wherein the first drive pulse and the second drive pulse each have at least (i) an expansion element that causes the pressure chamber to expand by changing from a standard potential, which is a standard for changes in potential, to an expansion potential, the expansion element extending from the standard potential to a lowest potential, and (ii) a contraction element that causes the expanded pressure chamber to contract by changing from the lowest potential that is on an expansion potential side of the standard potential to a contraction potential that exceeds the standard potential thereby ejecting the liquid, and wherein an initiation potential of the contraction element of the first drive pulse and an initiation potential of the contraction element of the second drive pulse are set to the same potential at the lowest potential, and wherein an ending potential of the contraction element of the first drive pulse is different from an ending potential of the contraction element of the second drive pulse.

2. The liquid ejecting apparatus according to claim 1, wherein the drive signal includes a third drive pulse that causes liquid droplets of a different size to those of the first drive pulse and the second drive pulse to be ejected from the nozzles, wherein the third drive pulse has at least (i) an expansion element that causes the pressure chamber to expand by changing from a standard potential, which is a standard for changes in potential, to an expansion potential, and (ii) a contraction element that causes the expanded pressure chamber to contract by changing from a potential that is on an expansion potential side of the standard potential to a contraction potential that exceeds the standard potential thereby ejecting the liquid, and wherein an initiation potential of the contraction element of the third drive pulse is set to the same potential as the initiation potential of the contraction element of the first drive pulse and the initiation potential of the contraction element of the second drive pulse.

3. The liquid ejecting apparatus according to claim 1, wherein the drive signal includes a third drive pulse that causes liquid droplets of the same size as those of either the first drive pulse or the second drive pulse to be ejected from the nozzles, wherein the third drive pulse has at least (i) an expansion element that causes the pressure chamber to expand by changing from a standard potential, which is a standard for changes in potential, to an expansion potential, and (ii) a contraction element that causes the expanded pressure chamber to contract by changing from a potential that is on an expansion potential side of the standard potential to a contraction potential that exceeds the standard potential thereby ejecting the liquid, and wherein an initiation potential of the contraction element of the third drive pulse is made to be uniform at the same potential as the initiation potential of the contraction element of the first drive pulse and the initiation potential of the contraction element of the second drive pulse.

4. The liquid ejecting apparatus according to claim 1, wherein the piezoelectric body is formed in a film-shape in which crystal is preferentially oriented.

5. The liquid ejecting apparatus according to claim 2, wherein the third drive pulse causes liquid droplets that are smaller than those of the first drive pulse and larger than those of the second drive pulse to be ejected from the nozzles.

* * * * *